US007059253B2

(12) United States Patent
Cho

(10) Patent No.: US 7,059,253 B2
(45) Date of Patent: Jun. 13, 2006

(54) TABLE AND MICROWAVE OVEN PROVIDED WITH TABLE

(75) Inventor: Pung Yeun Cho, Suon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 398 days.

(21) Appl. No.: 10/383,072

(22) Filed: Mar. 7, 2003

(65) Prior Publication Data

US 2004/0103827 A1 Jun. 3, 2004

(30) Foreign Application Priority Data

Nov. 29, 2002 (KR) ..... 10-2002-0075153

(51) Int. Cl.
*A47B 13/08* (2006.01)

(52) U.S. Cl. ..... 108/90; 108/43

(58) Field of Classification Search ..... 108/90, 108/91, 38, 157.1, 153.1, 43; 312/107, 108
See application file for complete search history.

(56) References Cited

U.S. PATENT DOCUMENTS 2,566,954 A 9/1951 Murray
2,663,603 A * 12/1953 Newman ..... 108/43
2,697,018 A * 12/1954 Georgides ..... 108/43
3,368,856 A * 2/1968 Tisdall et al. ..... 108/91
3,644,008 A * 2/1972 Overby ..... 312/107
3,653,734 A * 4/1972 Ungaro ..... 312/107
3,930,701 A * 1/1976 Otakie ..... 108/90
4,202,586 A * 5/1980 Oplinger ..... 312/107
4,232,916 A * 11/1980 Correia ..... 312/107
4,681,378 A * 7/1987 Hellman, III ..... 312/107
4,717,214 A * 1/1988 Moore et al. ..... 312/107
5,520,119 A * 5/1996 Eisenberg ..... 108/43
5,865,126 A * 2/1999 Miranda ..... 108/91
5,909,922 A * 6/1999 Dugas ..... 108/43
6,116,165 A * 9/2000 Kadesky ..... 108/43
RE37,239 E * 6/2001 Eisenberg ..... 108/43
6,520,095 B1 * 2/2003 Hayes ..... 108/190
6,536,614 B1 * 3/2003 Hsia et al. ..... 211/188
6,827,028 B1 * 12/2004 Callaway ..... 108/157.1

FOREIGN PATENT DOCUMENTS

DE 298 07 510 U1 8/1998
GB 2264047 A 8/1993
JP 1218404 8/1989

* cited by examiner

*Primary Examiner*—José V. Chen
(74) *Attorney, Agent, or Firm*—Staas & Halsey LLP

(57) ABSTRACT

A table adapted for a home appliance, such as a microwave oven, wherein the volume under the table is efficiently utilized to house the appliance. The table can be removed, used, and then returned and efficiently stored surrounding the appliance.

18 Claims, 2 Drawing Sheets

TABLE AND MICROWAVE OVEN PROVIDED WITH TABLE

CROSS-REFERENCE TO RELATED APPLICATIONS

This application claims the benefit of Korean Patent Application No. 2002-75153, filed Nov. 29, 2002, in the Korean Intellectual Property Office, the disclosure of which is incorporated herein by reference.

BACKGROUND OF THE INVENTION

1. Field of the Invention

The present invention relates to microwave ovens and, more particularly, to a table and a microwave oven provided with a table which can be kept easily.

2. Description of the Related Art

Generally, a table is an apparatus on which users put food that can be located a predetermined distance above the floor so that users may easily retrieve the food.

A table comprises a table part which is formed flat to put food on an upper surface of the table part, and leg parts that extend downward from the table part so as to locate the table part a predetermined distance above the floor.

In such a conventional table, the leg parts have a predetermined height and the volume of space between the table part and the floor is under-utilized.

SUMMARY OF THE INVENTION

Accordingly, it is an aspect of the present invention to provide a table which can be kept in a small space and a microwave oven provided with the above described table.

Additional objects and/or advantages of the invention will be set forth in part in the description which follows and, in part, will be obvious from the description, or may be learned by practice of the invention.

To achieve the above and/or other aspects of the present invention, there is provided a cabinet and a table comprising a table part, with an upper surface that is substantially flat, and leg parts which extend downward from the table part. The table part and the leg parts are installed mountably on the cabinet, which may house home appliances, including a microwave oven.

According to an aspect of the present invention, a lower surface of the above mentioned table part is formed to fit an upper surface of the cabinet. Additionally, the inner side surfaces of the leg parts are formed and installed to fit side surfaces of the cabinet. Thus, the upper surface and side surfaces of the cabinet are covered.

According to another aspect of the present invention, the table has at least one handle part to aid in transportation of the table.

According to yet another aspect of the present invention, the table has a supporting member to support the leg parts of the table. The supporting member has projections to engage the leg parts and the leg parts have projections to engage the supporting member projections.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
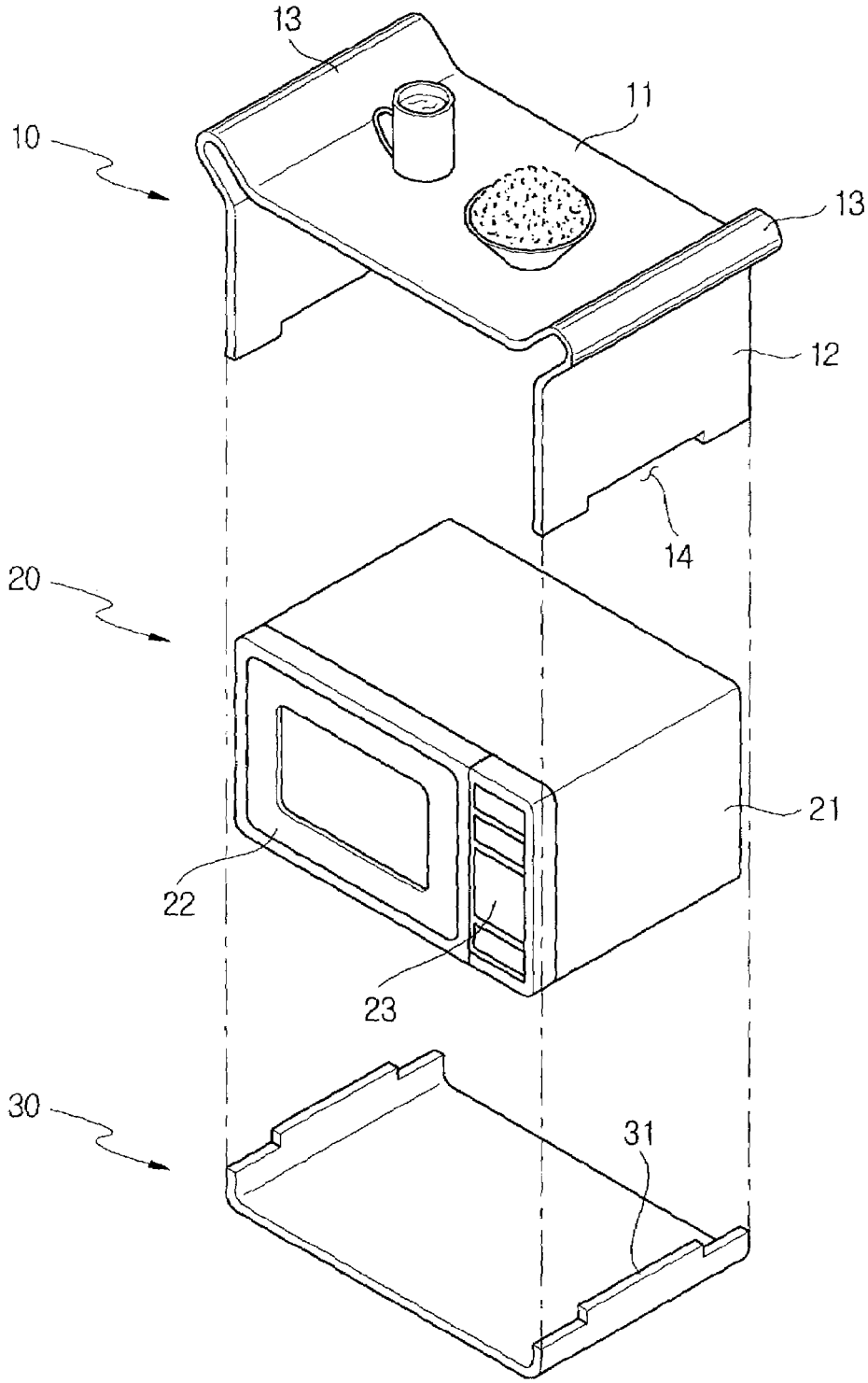
FIG. 1 is a perspective view of a table and a microwave oven according to an embodiment of the present invention when they are separated.

Reference will now be made in detail to embodiments of the present invention, examples of which are illustrated in the accompanying drawings, wherein like reference numerals refer to the like embodiments throughout. The embodiments are described below in order to explain the present invention by referring to the figures.

As shown in FIG. 1, a table part 11 of the table 10, is formed flat to hold food on an upper surface of the table part 11. Additionally, leg parts 12 extend downward from the table part 11 so as to locate the table part 11 a predetermined distance from the surface on which the table 10 is set.

Accordingly, setting the table 10 down on the surface and placing food on it allows users to easily retrieve the food.

In one embodiment, a handle part 13 is formed and projected outward from the table part 11 and leg parts 12, allowing users to easily grasp the table 10. In another embodiment (not shown) the handle part 13 is through openings formed in the leg parts 12. In a yet further embodiment (not shown), the handle part 13 is cavities formed in the leg parts 12. In yet another embodiment (not shown) the handle part 13 is through openings formed in the table part 11. In still yet another embodiment (not shown), the handle part 13 is cavities formed in the table part 11.

The table 10 according to present invention can be mountably set on the outer part of a cabinet 21 of various home appliances. Home appliances include: TV sets, refrigerators, toasters, toaster ovens, convection ovens, VCRs, DVD players, clocks, radios, stereo equipment, microwave ovens, and other appliances that have approximately rectangular shaped cabinets. An embodiment employing a microwave oven will be described below.

A microwave oven 20 is an electrically operated oven which heats and/or cooks food contained in its cooking cavity using high frequency electromagnetic waves generated by the oscillation of a magnetron(not shown) installed in a machine compartment. During operation of the microwave oven, the magnetron inside the machine compartment of the microwave oven radiates high frequency electromagnetic waves, so called "microwaves," through the cooking cavity. The microwaves thus penetrate food so as to repeatedly change the molecular arrangement of moisture laden in the food. That is, the molecules of the moisture are vibrated to generate a frictional heat within the food to cook the food.

The conventional microwave oven 20 generally comprises a cooking cavity (not shown) which is defined inside the cabinet 21, the cooking cavity has an approximately rectangular shape with an opening at front, and is used for cooking food therein. A machine compartment (not shown) is defined inside the cabinet 21 at a position under the cooking cavity, and receives a variety of devices used for generating microwaves, for instance, a magnetron.

In the front of the cabinet 21, there is a door 22 that is hinged at one side, and selectively opens and closes the cooking cavity. There is a control panel 23 at the other side of the front of the cabinet that has various manipulating buttons that control the function of the microwave oven .

The table 10 is movably mounted on the cabinet 21 of the microwave oven 20. To mount the table on the cabinet 21, the lower surface of the table part 11 and inner side surfaces of the leg parts 12 are formed to respectively complement the upper and side surfaces of the cabinet.

The lower surface of the table part 11 is formed substantially flat to be supported by the upper surface of the cabinet 21, which is also formed flat. And the distance between the leg parts 12 corresponds to the length of the cabinet 21. Accordingly, when the table 10 is mounted on the cabinet 21, the lower surface of the table part 11 is supported by the upper surface of the cabinet 21, and the inner part of the leg parts 12 are supported by the side surfaces of the cabinet 21.

The handle part 13, in one embodiment, is made of an elastic material, such that the leg parts 12 elastically contact the side surfaces of the cabinet 21. Such a handle part 13 would allow a user to slightly flex the handle part 13, biasing the leg parts 12 away from the side surfaces of the cabinet 21, and aiding removal of the table 10 from the cabinet 21. In another embodiment, the table part 11, leg parts 12, and the handle part 13 are all made of an elastic material.

The supporting member 30 is provided to prevent fore-aft translation of the table 10, relative to the microwave oven 20. The supporting member 30 is formed with a substantially flat bottom part, to mount the microwave oven on, and with side parts having projections 31 to support and engage the leg parts 12 of the table 10. The leg parts 12 have outer projection parts 14 that complement and engage the projections 31 of the supporting part 30.

Accordingly, the table 10 is mounted on the cabinet 21 so that the cabinet 21 is situated in the space between the two leg parts 12 of the cabinet 10. The outer projection parts 14, which are provided at the lower portions of the leg parts 12, engage the projection parts 31 of the supporting member 30, to prevent the table 10 from moving fore and aft relative to the microwave oven 20. The supporting member 30 is prevented from moving by the weight of the microwave oven 20.

As described above, the present invention provides a microwave oven provided with a table. It is also understood that other types of home appliances, such as TV sets and refrigerators, can be adapted to the present invention if they have an approximately rectangular shaped cabinet.

The construction and operation of a microwave oven provided with a table according to present invention will be described below with reference to FIGS. 1 and 2.

When a user wants to use the table 10 separately from the microwave oven 20, the user grasps the handle part 13 and moves the table 10 upwardly from the supporting part 30, thereby causing the outer projection parts 14 to disengage from the projection parts 31. Thus, the table 10 is separated from the cabinet 21, so the user can use and put food on the separated table.

Figure 2:
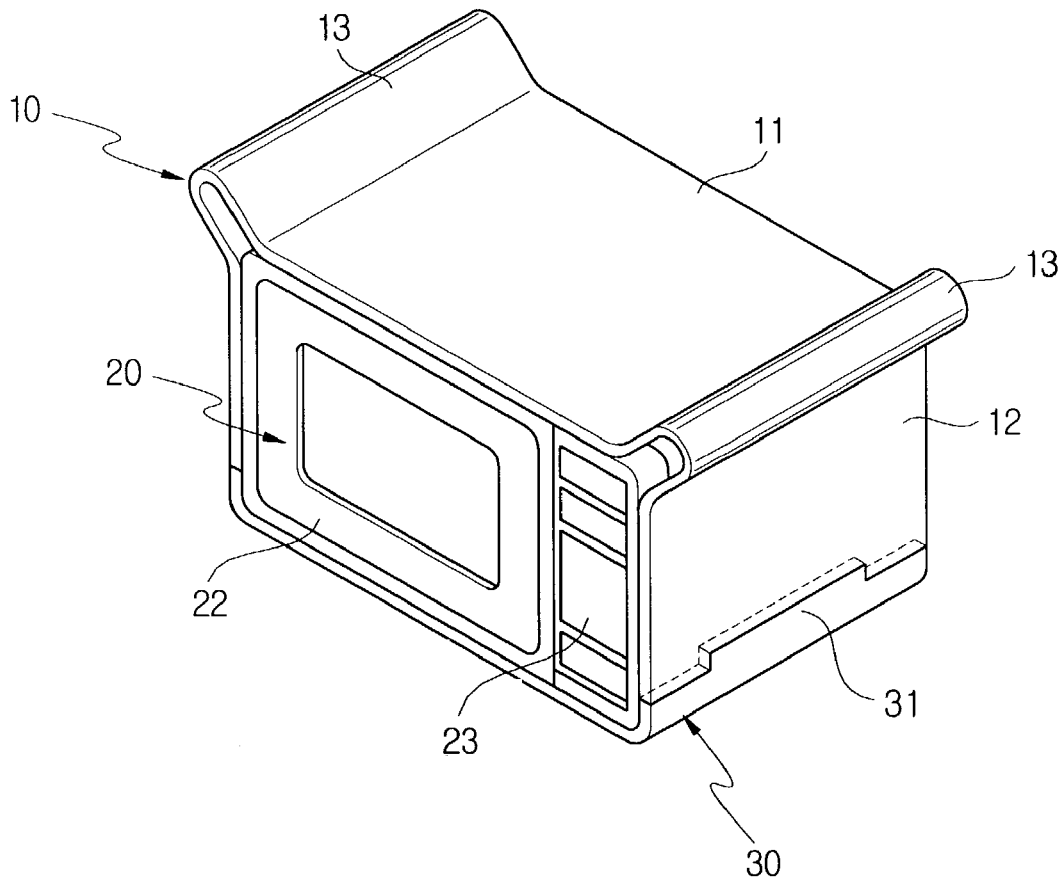
FIG. 2 is a perspective view of the table mounted on the microwave oven of FIG. 1.

When finished using the table 10 separately, the table 10 can be mounted on the cabinet 21 of the microwave oven 20 as shown in FIG. 2. The table 10 is mounted on the cabinet 21 so that the cabinet 21 is situated in the space between the two leg parts 12 of the table 10, such that the outer projection parts 14 of the leg parts 12 engage the projection parts 31 of the supporting member 30.

As described above, the present invention provides a table 10 and a microwave oven 20, wherein the space underneath the table is efficiently employed to house the microwave oven 20. Another effect of the present invention is that it is easy to change the color and design effect of the microwave oven by simply changing the table.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An apparatus, comprising:
a cabinet;
a table part which is formed substantially flat;
a pair of handle parts extending, at respective first ends thereof, from opposite ends of the table part; and
a pair of leg parts respectively extending from second ends of the handle parts, to form a contour to receive the cabinet,
wherein the handle parts
are elastically deformable to bias the leg parts away from the cabinet,
are u-shaped, and
extend outwardly at an inclination with respect to the table part, to form a handle graspable by a user.

2. The apparatus according to claim 1, wherein:
a lower surface of the table part fits an upper surface of the cabinet; and
an inner surface of the leg part fits a side surface of the cabinet.

3. The apparatus according to claim 1, wherein:
a lower surface of the table part contacts an upper surface of the cabinet; and
an inner surface of the leg part contacts a side surface of the cabinet.

4. The apparatus according to claim 1, wherein:
the cabinet houses a home appliance.

5. The apparatus according to claim 4, wherein:
the home appliance is a microwave oven.

6. The apparatus according to claim 1, wherein the handle parts elastically bias the leg parts toward the cabinet.

7. The apparatus according to claim 1, wherein the table part, handle parts, and leg parts are integrally formed of a single piece of elastic material.

8. An apparatus, comprising:
a cabinet;
a table part which is formed substantially flat;
a pair of handle parts extending, at respective first ends thereof, from opposite ends of the table part;
a pair of leg parts respectively extending from second ends of the handle parts, to form a contour to receive the cabinet; and
a supporting member with a pair of projection parts,
wherein the handle parts are elastically deformable to bias the leg parts away from the cabinet, and
the leg parts each have an outer projection part at distal ends thereof, to engage the respective projection parts.

9. The apparatus according to claim 8, wherein:
a lower surface of the table part contacts an upper surface of the cabinet; and
an inner surface of the leg part contacts a side surface of the cabinet.

10. The apparatus according to claim 9, wherein:
an upper surface of the supporting member contacts a lower surface of the cabinet.

11. An apparatus, comprising:
a cabinet; and
a table, the table comprising
a table part which is formed substantially flat,
a pair of leg parts, and
a pair of handle parts, respectively connecting an edge of the table part and an edge of one of the leg parts,
wherein the table part, handle part, and leg part form a contour to receive the cabinet, the handle part is made of an elastic material such that the leg part elastically contacts a side part of the cabinet, and the handle parts are elastically deformable to bias the leg parts away from the cabinet, to aid removal of the table from the cabinet are u-shaped, and extend outwardly at an inclination with respect to the table part, to form a handle graspable by a user.

12. The apparatus according to claim 11, wherein:

the table part and the leg parts are also made of the elastic material.

13. The apparatus according to claim 12, wherein:

the table part, the handle parts, and the leg parts are integrally formed of a single piece of the elastic material.

14. An apparatus, comprising:

a cabinet;

a table part which is formed substantially flat;

handle parts, respectively extending from opposing ends of the table part;

leg parts respectively extending from one of the handle parts; and a supporting member, separably engaging distal ends of the leg parts, wherein the table part, handle parts, leg parts, and supporting member form a cavity to receive the cabinet, and the handle parts are elastically deformable to bias the leg parts away from the cabinet.

15. The apparatus according to claim 14, wherein the table part, handle parts, and leg parts are integrally formed of a single piece of elastic material.

16. A table, comprising:

a table part which is formed substantially flat;

handle parts extending, at respective first ends thereof, from opposite ends of the table part; and leg parts respectively extending from second ends of the handle parts, wherein the handle parts are elastically deformable to move the leg parts away from each other, are u-shaped, and extend outwardly at an inclination with respect to the table part, to form a handle graspable by a user.

17. The table according to claim 16, wherein the table part, handle parts, and leg parts are integrally formed of a single piece of elastic material.

18. A table, comprising:

a table part which is formed substantially flat;

handle parts extending, at respective first ends thereof, from opposite ends of the table part; and leg parts respectively extending from second ends of the handle parts, wherein the table part, handle parts, and leg parts are integrally formed of a single piece of material, and the handle parts are u-shaped, and extend outwardly at an inclination with respect to the table part, to form a handle graspable by a user.

* * * * *